US011279014B2

(12) United States Patent
Yamamoto et al.

(10) Patent No.: US 11,279,014 B2
(45) Date of Patent: Mar. 22, 2022

(54) GAS COMBUSTION TYPE DRIVING TOOL

(71) Applicant: MAX CO., LTD., Tokyo (JP)

(72) Inventors: Yu Yamamoto, Tokyo (JP); Takashi Yuki, Tokyo (JP); Eiichi Watanabe, Tokyo (JP); Mitsuhiro Kimura, Tokyo (JP)

(73) Assignee: MAX CO., LTD., Tokyo (JP)

( * ) Notice: Subject to any disclaimer, the term of this patent is extended or adjusted under 35 U.S.C. 154(b) by 131 days.

(21) Appl. No.: 16/251,187

(22) Filed: Jan. 18, 2019

(65) Prior Publication Data

US 2019/0224826 A1 Jul. 25, 2019

(30) Foreign Application Priority Data

Jan. 19, 2018 (JP) ..... JP2018-007520
Jan. 19, 2018 (JP) ..... JP2018-007521
Jan. 19, 2018 (JP) ..... JP2018-007633

(51) Int. Cl.
*B25D 9/10* (2006.01)
*B25C 1/08* (2006.01)
(Continued)

(52) U.S. Cl.
CPC ..... *B25C 1/08* (2013.01); *B25D 9/10* (2013.01); *F02B 63/02* (2013.01); *F01L 9/10* (2021.01)

(58) Field of Classification Search
CPC ... B25C 1/08; F02B 63/02; B25D 9/10; F01L 9/02
(Continued)

(56) References Cited

U.S. PATENT DOCUMENTS 1,855,805 A * 4/1932 Luxmore ..... B25D 9/10 123/46 SC
3,042,008 A * 7/1962 Liesse ..... B21J 7/26 123/46 SC
(Continued)

FOREIGN PATENT DOCUMENTS

EP 2 433 753 A1 3/2012
EP 3 141 348 A1 3/2017
(Continued)

OTHER PUBLICATIONS

European Search Report issued in Application No. 19152463.6, dated Jul. 11, 2019, 7 pages.
(Continued)

*Primary Examiner* — Robert F Long
(74) *Attorney, Agent, or Firm* — Weihrouch IP

(57) ABSTRACT

A gas combustion type driving tool includes an output unit, a grip, a fuel container storage unit, a battery mounting unit and a coupler. The output unit includes a combustion chamber. The grip is connected to a lower surface of the output unit. A fuel container is detachably attached to the fuel container storage unit. A battery pack is detachably attached to the battery mounting unit. The coupler is configured to take air in. The fastener is driven out by combustion pressure when mixed gas of combustible gas supplied from the fuel container and compressed air supplied from outside via the coupler is ignited. The coupler is disposed on a lower end side of the grip. The gas combustion type driving tool includes a pipe configured to connect the coupler and the combustion chamber.

15 Claims, 9 Drawing Sheets

(51) Int. Cl.
*F02B 63/02* (2006.01)
*F01L 9/10* (2021.01)

(58) Field of Classification Search
USPC ..... 173/90, 200–201, 122, 127–128, 133, 173/135–138
See application file for complete search history.

(56) References Cited

U.S. PATENT DOCUMENTS 3,381,672 A * 5/1968 Tobias ..... B21J 7/26 123/46 SC
3,638,534 A * 2/1972 Ramspeck ..... B25C 1/041 91/399
3,850,359 A 11/1974 Obergfell
3,967,771 A * 7/1976 Smith ..... B25C 1/08 227/10
4,075,850 A 2/1978 Nakazato et al.
4,290,489 A * 9/1981 Leavell ..... B25D 9/14 173/133
4,483,474 A * 11/1984 Nikolich ..... B25C 1/008 123/46 SC
4,739,915 A * 4/1988 Cotta ..... B25C 1/08 227/10
5,119,667 A * 6/1992 Hollis ..... B21D 1/06 72/453.16
5,191,861 A * 3/1993 Kellerman ..... B25C 1/08 123/46 SC
5,363,999 A 11/1994 Braun et al.
5,370,295 A 12/1994 Simonelli
5,873,508 A * 2/1999 MacVicar ..... B25C 1/08 227/10
6,148,507 A * 11/2000 Swanson ..... B21J 15/105 29/243.53
6,237,827 B1 5/2001 Reckelhoff
6,247,626 B1 * 6/2001 MacVicar ..... B25C 1/008 227/10
6,378,288 B1 4/2002 Towfighi et al.
6,722,550 B1 4/2004 Ricordi et al.
7,150,139 B1 * 12/2006 Lund ..... A01D 34/00 56/10.8
2003/0127238 A1 * 7/2003 Largo ..... B25C 1/04 173/200
2004/0079302 A1 4/2004 Wolf et al.
2004/0134961 A1 7/2004 Wolf et al.
2004/0182909 A1 * 9/2004 Lund ..... B25C 1/08 227/130
2006/0185113 A1 * 8/2006 Kloeppel ..... A47L 11/4083 15/320
2007/0034395 A1 * 2/2007 Glaser ..... B25D 9/26 173/30
2007/0059186 A1 * 3/2007 Weaver ..... B25C 1/04 417/234
2007/0210132 A1 9/2007 Akiba
2008/0251558 A1 10/2008 Suda
2008/0314952 A1 * 12/2008 Tamura ..... B25C 1/08 227/10
2010/0176177 A1 7/2010 Tanaka
2010/0230461 A1 9/2010 Tasaka
2010/0327040 A1 * 12/2010 Aihara ..... B25C 1/047 227/130
2011/0068141 A1 * 3/2011 Wolf ..... B25C 1/08 227/9
2011/0108600 A1 * 5/2011 Pedicini ..... B25C 1/047 227/2
2011/0240709 A1 * 10/2011 Oouchi ..... B25C 1/08 227/8
2012/0132690 A1 * 5/2012 Dittrich ..... B25C 1/08 227/10
2012/0153303 A1 6/2012 Dittrich
2012/0211539 A1 8/2012 Kosuge et al.
2013/0082083 A1 * 4/2013 Largo ..... B25C 1/041 227/8
2013/0082085 A1 * 4/2013 Largo ..... B25C 7/00 227/130
2013/0134204 A1 * 5/2013 Morioka ..... B25C 1/005 227/9
2013/0270319 A1 * 10/2013 Gauger ..... B25C 1/08 227/2
2014/0069981 A1 * 3/2014 Ricordi ..... B25C 1/08 227/8
2016/0144496 A1 5/2016 Raggl et al.
2016/0151901 A1 * 6/2016 Nishida ..... B25C 1/184 227/8
2016/0214249 A1 7/2016 Bruggmueller et al.
2016/0303724 A1 10/2016 Dittrich et al.
2018/0243891 A1 8/2018 Dittrich et al.
2019/0001474 A1 1/2019 Schmidt et al.
2019/0224827 A1 * 7/2019 Yamamoto ..... B25D 9/10
2019/0224828 A1 * 7/2019 Watanabe ..... B25D 9/10
2019/0224830 A1 * 7/2019 Yamamoto ..... B25C 1/008
2019/0224831 A1 * 7/2019 Yamamoto ..... B25D 9/10
2019/0224833 A1 * 7/2019 Watanabe ..... F02B 63/02
2020/0149740 A1 * 5/2020 Tsai ..... F23D 14/52

FOREIGN PATENT DOCUMENTS

JP S50-015177 A 2/1975
JP 51-58768 5/1976
JP 53-004384 U 1/1978
JP H07-164349 A 6/1995
JP 2000-158361 A 6/2000
JP 2001-260049 A 9/2001
JP 2004-034288 A 2/2004
JP 2004-333120 A 11/2004
JP 2005-219193 A 8/2005
JP 2007-237328 A 9/2007
JP 2008-036800 A 2/2008
JP 2008-260100 A 10/2008
JP 2009-45676 A 3/2009
JP 2012-125919 A 7/2012
JP 2012-171055 A 9/2012
JP 2016-525454 A 8/2016
JP 2016-538146 A 12/2016
WO 2009-051195 A1 4/2009

OTHER PUBLICATIONS

Japanese Office Action for corresponding JP Application No. 2018-007520 dated Aug. 3, 2021. (4 pp).
Japanese Office Action for Appl. No. 2018-007521 dated Aug. 24, 2021 (4 pages, non-English).
Japanese Office Action for Appl. No 2018-007633 dated Aug. 24, 2021 (4 pages, non-English).

* cited by examiner

GAS COMBUSTION TYPE DRIVING TOOL

CROSS-REFERENCE TO RELATED APPLICATIONS

This application is based on and claims priority under 35 USC 119 from Japanese Patent Application Nos. 2018-007520 filed on Jan. 19, 2018, 2018-007521 filed on Jan. 19, 2018, 2018-007633 filed on Jan. 19, 2018, the contents of which are incorporated herein by reference.

TECHNICAL FIELD

The present invention relates to a gas combustion type driving tool that drives a fastener by combustion pressure of combustible gas.

BACKGROUND ART

A gas combustion type driving tool that drives a fastener by combustion pressure of combustible gas is known in the related art (see, for example, JP-A-2009-45676). Such a gas combustion type driving tool requires a power source to electrically control supply of the combustible gas and ignition of a spark plug. The gas combustion type driving tool disclosed in JP-A-2009-45676 includes a battery pack serving as the power source. A weight of the tool is distributed at both ends of a grip by attaching the battery pack to a grip end, so that weight balance is optimally maintained.

In order to obtain a large output in such a gas combustion type driving tool, it is necessary to increase an amount of combustible gas supplied to a combustion chamber. However, a mixing ratio of air and the combustible gas gets out of order by simply increasing the amount of combustible gas, resulting in incomplete combustion. Therefore, it is necessary to increase an amount of air in accordance with the increase in the combustible gas, that is, it is necessary to increase a volume of the combustion chamber.

Meanwhile, a pneumatic driving tool that drives a fastener by actuating a piston with compressed air is also widely used (see, for example, JP-A-2005-219193). In such a pneumatic driving tool, compressed air stored in an air chamber is supplied above a piston at once. The piston is driven by air pressure thus generated in an impacted manner. Therefore, in order to obtain a large output, it is necessary to ensure an air chamber as large as possible. In the pneumatic driving tool disclosed in JP-A-2005-219193, an air plug is provided at a grip end, and a hose is detachably attached to the air plug, so that compressed air can be supplied from outside. By using inside of a grip as the air chamber, a volume of the air chamber can be ensured as large as possible.

As described above, in order to increase the output of the gas combustion type driving tool, it is necessary to increase the volume of the combustion chamber, while in order to increase the output in the pneumatic driving tool, it is necessary to increase the volume of the air chamber. However, there is a limit to a feasible output as there is a limit to a size and weight that can be used as a hand-held tool. For example, in order to obtain output comparable to a pyrotechnic type driving tool, there is a problem that a driving tool may exceed a practically usable size as a hand-held tool.

As a method for solving such a problem, JP-A-S51-58768 discloses an idea that a fastener is driven out by combustion pressure when mixed gas of combustible gas and compressed air is ignited. That is, although air and combustible gas are mixed in the gas combustion type driving tool in the related art, it is possible to increase a mass of air contained in the mixed gas without expanding a combustion chamber by using compressed air instead of air. Then, a large output can be obtained by energy of the compressed air and thermal energy of the combustion gas.

SUMMARY OF INVENTION

Problems to be Solved by Invention

However, a configuration disclosed in JP-A-S51-58768 is merely an idea, and there are various problems in practical use.

A biggest problem is with a layout, that is, where to dispose a battery pack and an inlet of compressed air. For example, in the configuration disclosed in JP-A-S51-58768, the inlet of compressed air is disposed at a grip end. In such an arrangement, however, the battery pack cannot be disposed at the grip end, making it difficult to properly maintain balance of the tool. The battery pack is not disclosed in the configuration in JP-A-S51-58768, and the problem of where to dispose the battery pack is shelved.

Therefore, an object of the present invention is to provide a gas combustion type driving tool that drives a fastener using combustible gas and compressed air, in which a well-balanced layout can be realized.

Means for Solving Problems

The present invention is made to solve the above-described problems. A gas combustion type driving tool includes an output unit, a grip, a fuel container storage unit, a battery mounting unit and a coupler. The output unit includes a combustion chamber. The grip is connected to a lower surface of the output unit. A fuel container is detachably attached to the fuel container storage unit. A battery pack is detachably attached to the battery mounting unit. The coupler is configured to take air in. The fastener is driven out by combustion pressure when mixed gas of combustible gas supplied from the fuel container and compressed air supplied from outside via the coupler is ignited. The coupler is disposed on a lower end side of the grip. The gas combustion type driving tool includes a pipe configured to connect the coupler and the combustion chamber.

Effect of Invention

As described above, the fastener is driven out by combustion pressure when the mixed gas of combustible gas supplied from the fuel container and compressed air supplied from outside via the coupler is ignited. Therefore, a large output can be obtained by energy of the compressed air and thermal energy of the combustion gas even if a volume of the combustion chamber or an air chamber is not extremely large. Specifically, output comparable to a pyrotechnic type driving tool can be obtained with a tool size in a range that can be used as a hand-held tool. Further, unlike the pyrotechnic type driving tool, the tool can be used without a special license, and maintenance is also easy.

The coupler is on the lower end side of the grip, and includes a pipe for connecting the coupler and the combustion chamber. Such a configuration makes it possible to freely arrange a position of the coupler. For example, it is possible to adopt a layout in which the battery pack is mounted on a lower end portion of the grip and the coupler (inlet for compressed air) is disposed in proximity to the battery pack. According to such a layout, weight balance of the tool can be improved by allowing the battery pack to be mounted on the lower end portion of the grip. Further, work can be easily done since work places such as attachment and detachment of the battery pack and a hose are both on the lower end side of the grip. Since it is possible to dispose the coupler at a position away from the output unit so as not to receive shocks of the output unit, loosening of the coupler due to shocks can be prevented.

DESCRIPTION OF EMBODIMENTS

Figure 1:
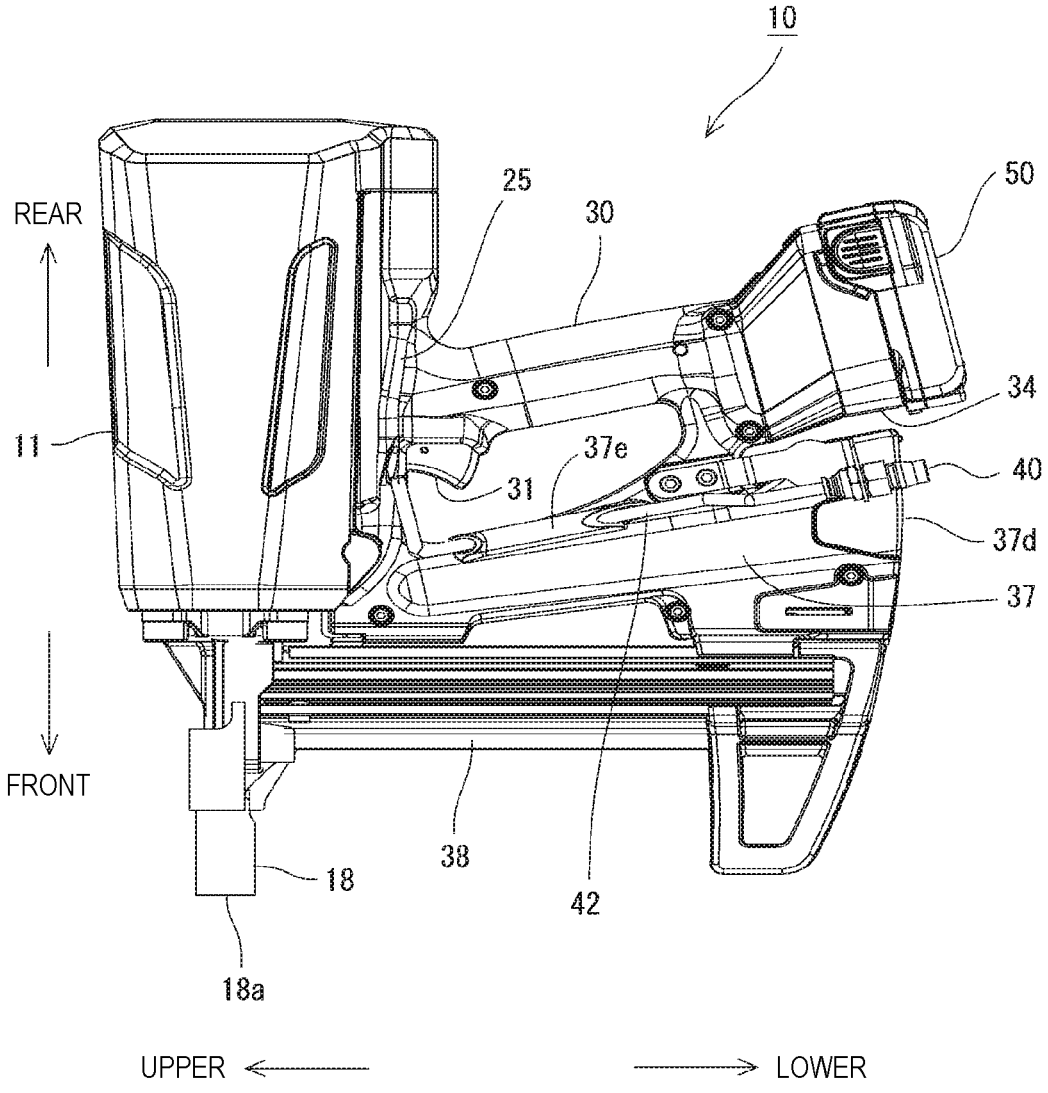
FIG. 1 is a side view of a gas combustion type driving tool.

Embodiments of the present invention are described with reference to the drawings. In the following description, as illustrated in FIG. 1, a direction in which a fastener is driven out is described as "front", and an opposite direction is described as "rear". When viewed in a direction orthogonal to the direction in which a fastener is driven out, that is, in a direction in which a grip 30 is extended, a direction in which an output unit 11 is located is described as "upper" and an opposite direction is described as "lower".

Figure 2:
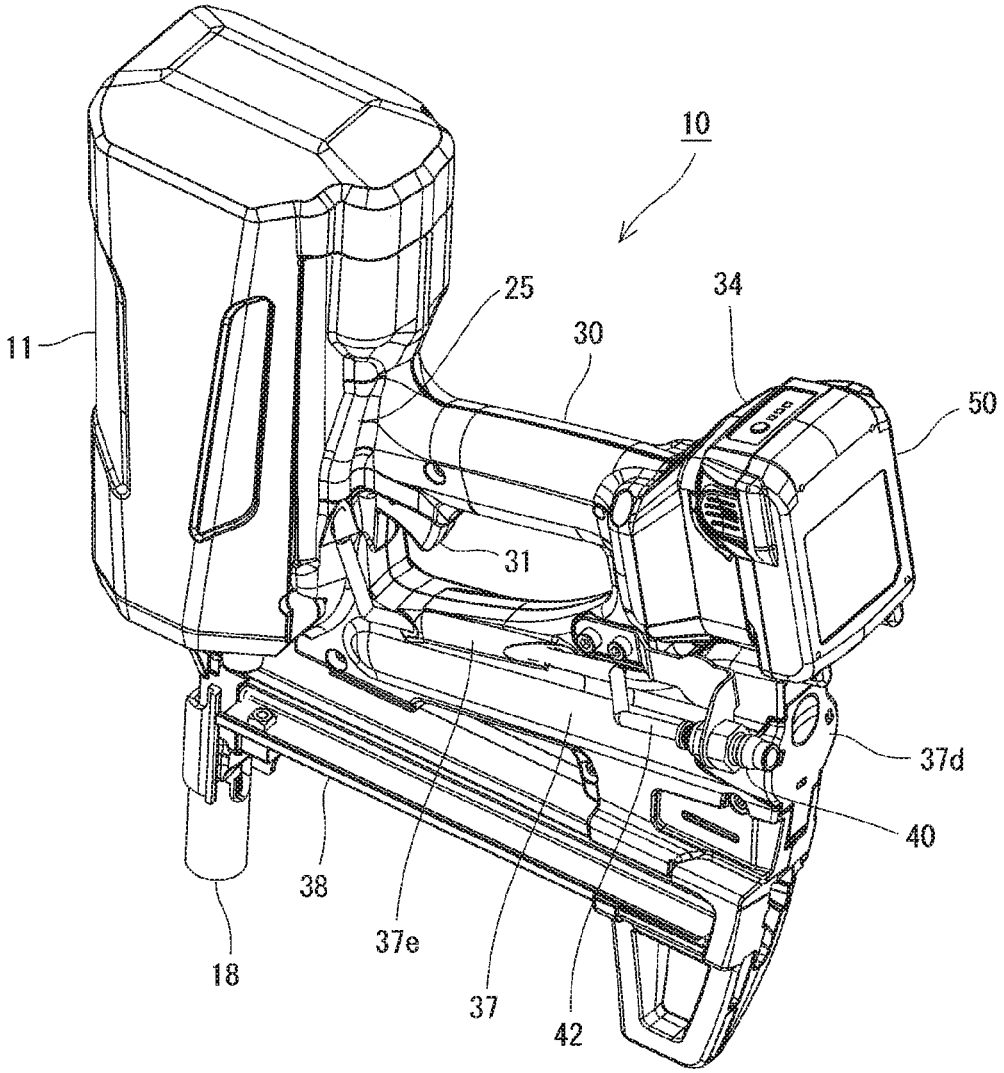
FIG. 2 is a perspective view of the gas combustion type driving tool.

A gas combustion type driving tool 10 according to the present embodiment drives a fastener out by combustion pressure when mixed gas of combustible gas and compressed air is ignited. As illustrated in FIGS. 1 and 2, the gas combustion type driving tool 10 includes the output unit 11, the grip 30, a fuel container storage unit 37, a magazine 38, and a coupler 40.

Figure 3:
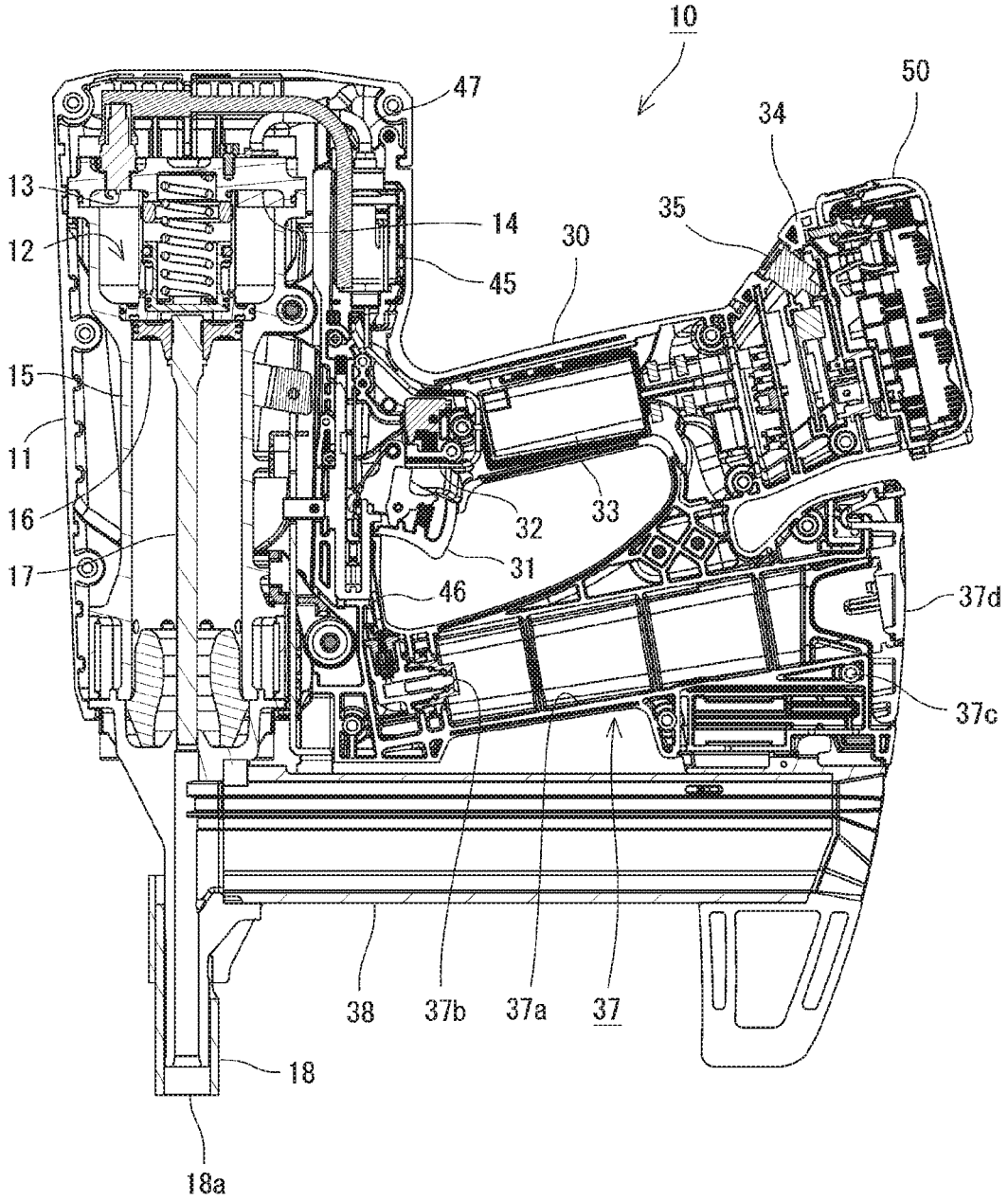
FIG. 3 is a side cross-sectional view of the gas combustion type driving tool.
Figure 4:
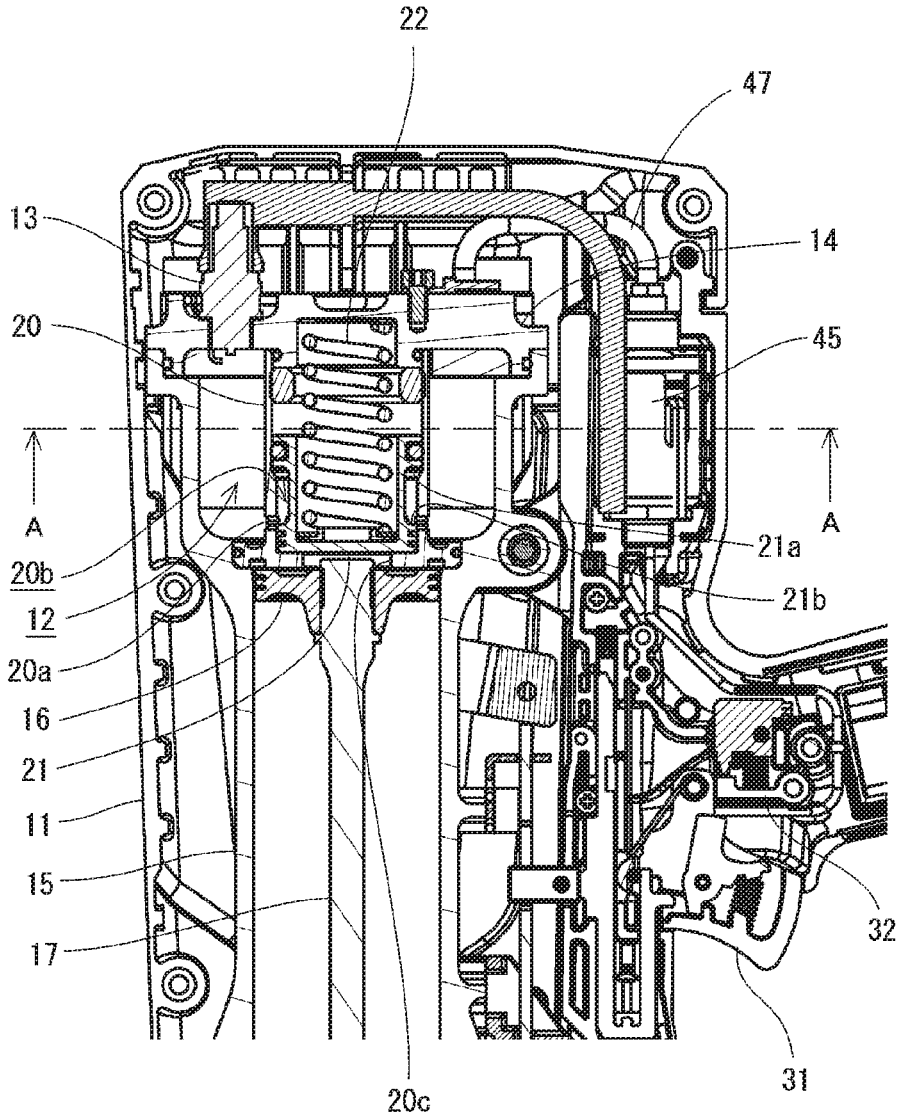
FIG. 4 is an enlarged partial side sectional view of the gas combustion type driving tool.

As illustrated in FIGS. 3 and 4, the output unit 11 includes a combustion chamber 12. The combustion chamber 12 is a space for burning combustible gas and is used as a space that can be sealed in rear (the direction opposite to the direction in which a fastener is driven out) of a piston 16 to be described below. Combustion pressure generated in the combustion chamber 12 is used to drive out a fastener by operating on the piston 16.

At a front end of the output unit 11, a nose portion 18 is attached to guide a fastener to a workpiece. When a driving operation is performed by operating a trigger operating unit 31 to be described below, the fastener is driven to the workpiece from an ejection outlet 18*a*. The ejection outlet 18*a* opens to a front end of the nose portion 18.

The nose portion 18 can be pushed into the output unit 11, and the driving operation is not performed even if the trigger operating unit 31 is operated, unless the nose portion 18 is pushed in. Specifically, a safety switch (not illustrated) is turned on by pushing in the nose portion 18, and a signal of a trigger switch 32 to be described below is not enabled unless the safety switch is turned on. Therefore, the fastener is not driven out unless the nose portion 18 is pressed against the workpiece, so that safety is ensured.

As illustrated in FIG. 4 and the like, the output unit 11 houses, inside a housing thereof, an ignition device 13, a cylinder head 14, a cylinder 15, a piston 16, a driver 17, a cylindrical member 20, a movable plug 21, a compression spring 22, and the like.

The ignition device 13 is used to generate a spark inside the combustion chamber 12. For example, the ignition device 13 is a spark plug that generates a spark by raising a voltage of a battery pack 50 to be described below to a high voltage and discharging the high voltage. The ignition device 13 performs an ignition operation at a predetermined timing based on a signal from a control device 33 to be described below. When the ignition device 13 ignites the mixed gas in the combustion chamber 12, a high-pressure combustion gas is generated in the combustion chamber 12, so that the piston 16 to be described below slides in an impacted manner by combustion pressure thus generated.

The cylinder head 14 constitutes the combustion chamber 12 together with the cylinder 15 to be described below. The cylinder head 14 is fixed to close a rear end of the cylinder 15. The cylinder head 14 is provided with an air ejection unit 44 and a gas ejection unit 48 to be described below, so that compressed air and combustible fuel container be introduced into the combustion chamber 12 from the air ejection unit 44 and the gas ejection unit 48.

The cylinder 15 is disposed in a longitudinal direction of the output unit 11. The cylinder 15 has two spaces in the front and rear. The space in the front guides the piston 16 to be described below to be slidable therein. The space in the rear constitutes the combustion chamber 12. The two spaces in the front and rear are connected with each other, and the cylindrical member 20 to be described below is attached between the two spaces. The front and rear two spaces can be shielded by the movable plug 21 housed in the cylindrical member 20.

The piston 16 is slidably housed inside the cylinder 15. When the high-pressure combustion gas is generated in the combustion chamber 12, the combustion gas operates on the piston 16, so that the piston 16 is actuated forward.

The driver 17 is used to hit a fastener and is coupled to front of the piston 16. When the driving operation is performed, the driver 17 slides along an ejection path of the fastener and drives the fastener in the ejection path out of the ejection outlet 18*a*.

The cylindrical member 20 is fixed to the cylinder 15 in the combustion chamber 12. The cylindrical member 20 includes a pressure chamber 20*b* therein that actuates the movable plug 21 to be described below. On a side portion of the cylindrical member 20, a first opening 20*a* is provided to connect the combustion chamber 12 and the pressure chamber 20*b*. On an end surface of the cylindrical member 20 facing the piston 16, a second opening 20*c* is provided to connect the combustion chamber 12 and a space in rear of the piston 16.

The movable plug 21 is a columnar member slidably disposed inside the cylindrical member 20. The movable plug 21 is biased in a direction toward the piston 16 by the compression spring 22, and closes the second opening 20*c* when in a natural state. Therefore, the combustion chamber 12 and the space in rear of the piston 16 are shielded by the movable plug 21 before the driving operation, resulting in a sealed space in the combustion chamber 12.

The movable plug 21 includes a groove in an outer periphery thereof, so that the pressure chamber 20*b* is defined between the groove and an inner peripheral surface of the cylindrical member 20. The pressure chamber 20*b* is connected with the combustion chamber 12 when in a natural state, resulting in the same air pressure as air pressure in the combustion chamber 12. The groove of the movable plug 21 includes a first pressure receiving surface 21*a* and a second pressure receiving surface 21*b* respectively in upper and lower edges of the groove to receive air pressure in the pressure chamber 20*b*. In the present embodiment, the first pressure receiving surface 21*a* has an area larger than an area of the second pressure receiving surface 21*b*, so that the movable plug 21 is actuated by a difference in pressure receiving areas. That is, when the air pressure in the pressure chamber 20*b* is increased, a force acts to slide the movable plug 21 in a direction away from the piston 16. The movable plug 21 slides rearward when the force overcomes a biasing force of the compression spring 22.

Therefore, the movable plug 21 slides to open the second opening 20*c* when the air pressure in the pressure chamber 20*b* (that is, the combustion chamber 12) exceeds a certain level. When the second opening 20*c* is opened, the combustion chamber 12 is connected with the space in rear of the piston 16, so that air (combustion gas) in the combustion chamber 12 flows into rear of the piston 16. Specifically, when the combustible gas burns in the combustion chamber 12 and pressure in the combustion chamber 12 increases, the movable plug 21 slides such that the combustion gas is allowed to flow into rear of the piston 16, and the piston 16 is driven by combustion pressure.

The grip 30 is connected to a lower surface of the output unit 11, and is substantially orthogonal to the direction in which a fastener is driven out. A user of the gas combustion type driving tool 10 can hold the tool stably by gripping the grip 30.

The grip 30 is provided with the trigger operating unit 31 that can be pulled. The trigger operating unit 31 is disposed at such a position that an index finger is applied to the trigger operating unit 31 when the grip 30 is gripped. When the trigger operating unit 31 is operated, the trigger switch 32 inside the grip 30 is pressed and turned on. A signal output from the trigger switch 32 turned on is transmitted to and processed by the control device 33 inside the grip 30. Specifically, when both the safety switch and the trigger switch 32 are turned ON, the control device 33 performs a predetermined driving operation (details of the driving operation is described below).

On a lower end surface of the grip 30, a battery mounting unit 34 is provided, to which a battery pack 50 can be detachably attached. The gas combustion type driving tool 10 according to the present embodiment is driven by electric power supplied from the battery pack 50 having a built-in secondary battery. Accordingly, the gas combustion type driving tool 10 is used in a state in which the battery pack 50 is mounted on the battery mounting unit 34. In the present embodiment, the battery pack 50 can be mounted on the battery mounting unit 34 by being slid from rear. The battery pack 50 can also be detached from the battery mounting unit 34 by being slid rearward.

The fuel container storage unit 37 is used for mounting a fuel container that is a supply source of combustible gas to be supplied to the combustion chamber 12. As illustrated in FIG. 3, the fuel container storage unit 37 according to the present embodiment is of a cylindrical shape and is disposed in front of the grip 30. A central axis of the fuel container storage unit 37 is substantially parallel to the grip 30.

The fuel container storage unit 37 according to the present embodiment includes a cylindrical portion 37*a* in which a fuel container is held in a slidable manner, a connection portion 37*b* disposed at an innermost portion of the cylindrical portion 37*a*, and a lid 37*d* disposed in the front of the cylindrical portion 37*a* .

The connection portion 37*b* connects a nozzle of a fuel container. The connection portion 37*b* is connected to a first gas pipe 46 to be described below. By connecting the nozzle of a fuel container to the connection portion 37*b*, combustible gas in the connected fuel container can be guided to the combustion chamber 12.

The lid 37*d* is attached to the fuel container storage unit 37 and can be opened and closed. Specifically, the lid 37*d* is rotatably supported by the fuel container storage unit 37 via a hinge 37*c*, so that inside of the fuel container storage unit 37 can be opened or sealed by rotating the lid 37*d*. By opening the lid 37*d*, a fuel container stored in the fuel container storage unit 37 can be taken out, and a fuel container can also be inserted into the fuel container storage unit 37.

The magazine 38 is used for loading a plurality of fasteners those can be driven out, and is connected to a lower side of the nose portion 18. The fasteners loaded in the magazine 38 are sequentially supplied to the nose portion 18, in which a leading fastener supplied to the nose portion 18 is hit and driven out by the driver 17. The magazine 38 according to the present embodiment allows connected fasteners to be aligned in a straight line.

The coupler 40 connects, for example, a plug of a hose that is connected to an air supply source such as an air compressor, and is used for taking in compressed air from outside. The coupler 40 is disposed on a lower end side of the grip 30, and particularly at a position lower than the grip 30 that can be gripped by the user. In other words, the coupler 40 is closer to a lower end than a center of the grip 30 when the grip 30 is viewed in its longitudinal direction. Further, the coupler 40 is opened downward. The gas combustion type driving tool 10 according to the present embodiment is used for driving fasteners by transmitting the compressed air supplied from outside to the combustion chamber 12 through the coupler 40.

As illustrated in FIG. 2, the coupler 40 is provided at a position shifted to a side (left side as viewed from a user holding the grip 30) of the grip 30 as viewed with respect to the grip 30. Specifically, the coupler 40 is on a lateral side of the fuel container storage unit 37. Further, the coupler 40 is shifted forward from the battery mounting unit 34. In this manner, the coupler 40 is shifted from and close to the battery mounting unit 34 and the fuel container storage unit 37, so as not to interfere with the battery mounting unit 34 and the fuel container storage unit 37. Therefore, parts requiring attachment/detachment such as the battery mounting unit 34, the fuel container storage unit 37, and the coupler 40 are collectively disposed on the lower end side of the grip 30, resulting in good operability. Since the battery mounting unit 34, the fuel container storage unit 37, and the coupler 40 are arranged in a compact manner, the gas combustion type driving tool 10 is not large in size and is easy to handle.

As illustrated in FIG. 1, the coupler 40 does not protrude downward relative to the battery pack 50 mounted on the battery mounting unit 34. Therefore, the coupler 40 does not protrude beyond an outline of the gas combustion type driving tool 10, resulting in good operability of the tool when a hose is connected to the coupler 40. With the coupler 40 within the outline of the tool, the coupler 40 is less likely to come into contact with ground when the tool is placed on the ground or the like, so that dust or the like is less likely to adhere to the coupler 40.

Next, an introduction path of compressed air and combustible gas into the combustion chamber 12 is described.

The compressed air supplied from outside is introduced into the tool through the coupler 40 as described above. The gas combustion type driving tool 10 according to the present embodiment includes a pipe for connecting the coupler 40 and the combustion chamber 12. Specifically, the gas combustion type driving tool 10 includes a first air pipe 42 constituting an introduction path from the coupler 40 to an air ejection valve 41 (described below) and a second air pipe 43 constituting an introduction path from the air ejection valve 41 to the combustion chamber 12.

Figure 8:
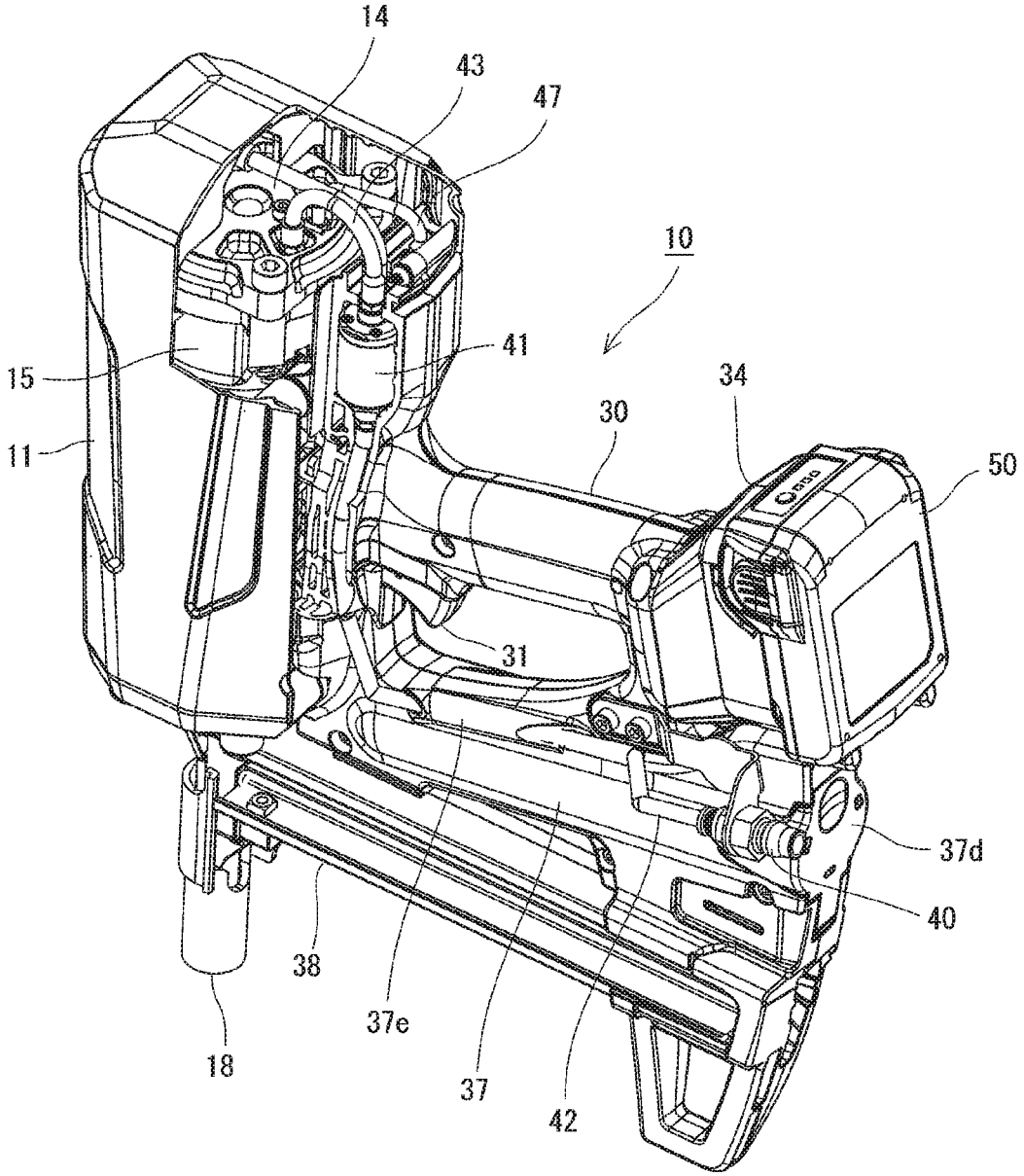
FIG. 8 is a perspective view illustrating an internal structure of the gas combustion type driving tool.

The first air pipe 42 has an upstream end connected to the coupler 40, and a downstream end connected to the air ejection valve 41. As illustrated in FIGS. 1 and 8, an upstream side of the first air pipe 42 is disposed along a lateral surface of the fuel container storage unit 37.

A downstream side of the first air pipe 42 is disposed along a lateral surface of the output unit 11. The fuel container storage unit 37 and the output unit 11 are connected in a substantially L shape. Accordingly, the first air pipe 42 is bent into an L shape at a connection position of the fuel container storage unit 37 and the output unit 11. The first air pipe 42 according to the present embodiment is formed of an elastically bendable tube.

A part of the first air pipe 42 is exposed outside a housing of the tool. Specifically, the first air pipe 42 passes through a tunnel-shaped pipe holding unit 37*e* on the lateral surface of the fuel container storage unit 37, and is inserted into a pipe cover unit 25 on the lateral surface of the output unit 11. Other parts of the first air pipe being exposed outside. According to such a configuration, the first air pipe 42 is inserted and assembled to the tool from outside of the housing, resulting in good assembling properties.

Figure 6:
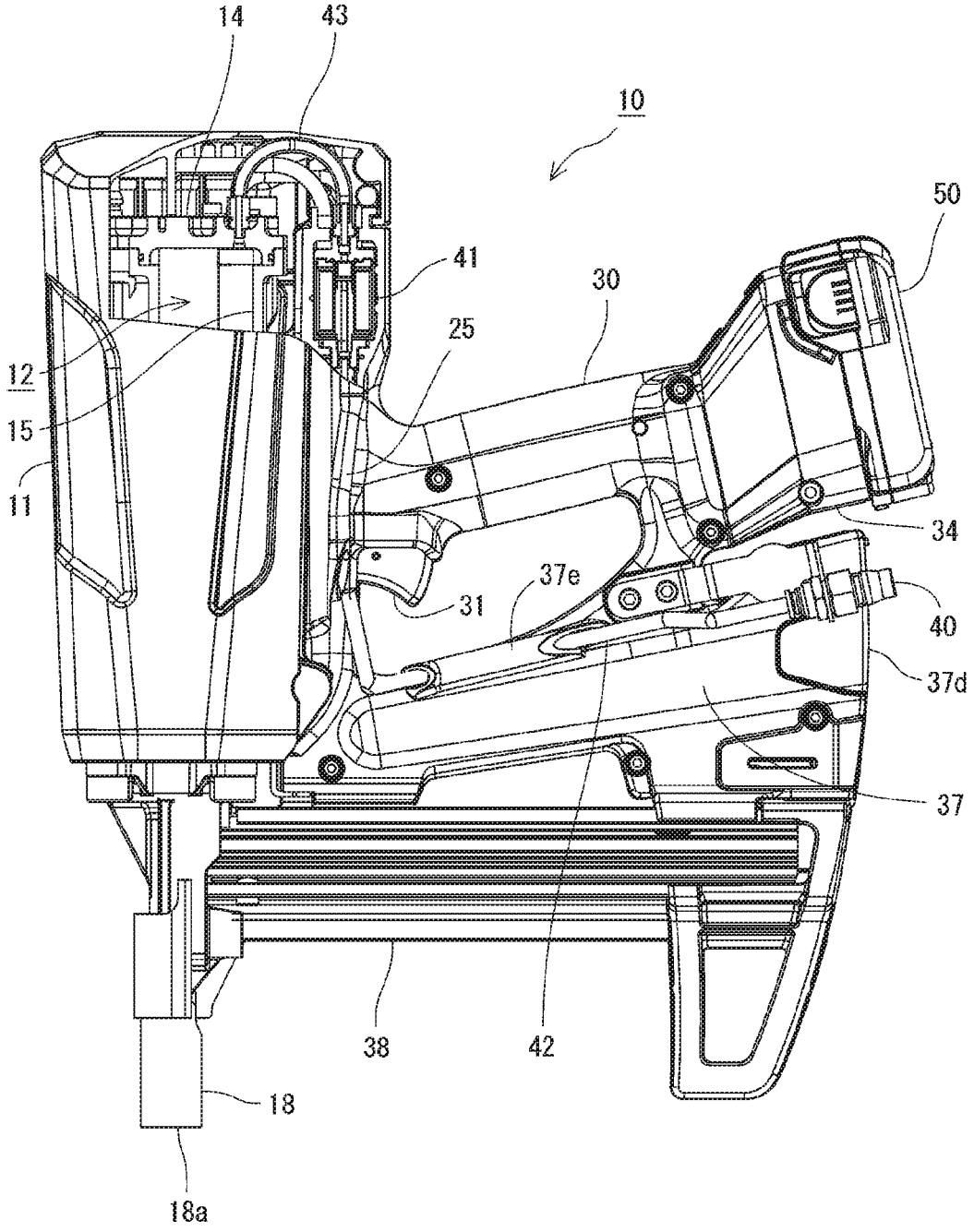
FIG. 6 is a side view (partial sectional view taken along a line B-B) of the gas combustion type driving tool.

The air ejection valve 41 is an electromagnetic valve that controls an amount of compressed air supplied to the combustion chamber 12. The air ejection valve 41 measures the compressed air supplied through the first air pipe 42, and ejects a certain amount of the compressed air into the combustion chamber 12. As illustrated in FIG. 6, the air ejection valve 41 according to the present embodiment is adjacent to the combustion chamber 12. Therefore, a distance of the second air pipe 43 to be described below can be short, making it possible to improve a response of the tool. The first air pipe 42 according to the present embodiment is longer than the second air pipe 43. In this way, the response of the tool is improved by lengthening the first air pipe 42 and shortening the second air pipe 43.

Figure 5:
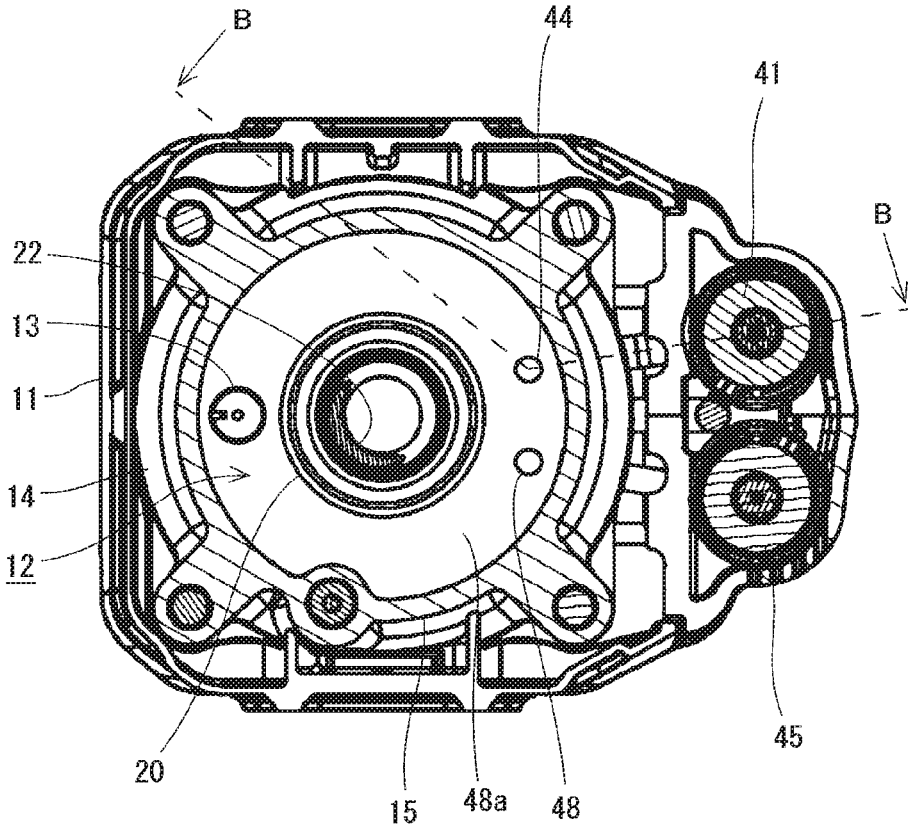
FIG. 5 is a cross-sectional view taken along a line A-A of the gas combustion type driving tool.
Figure 7:
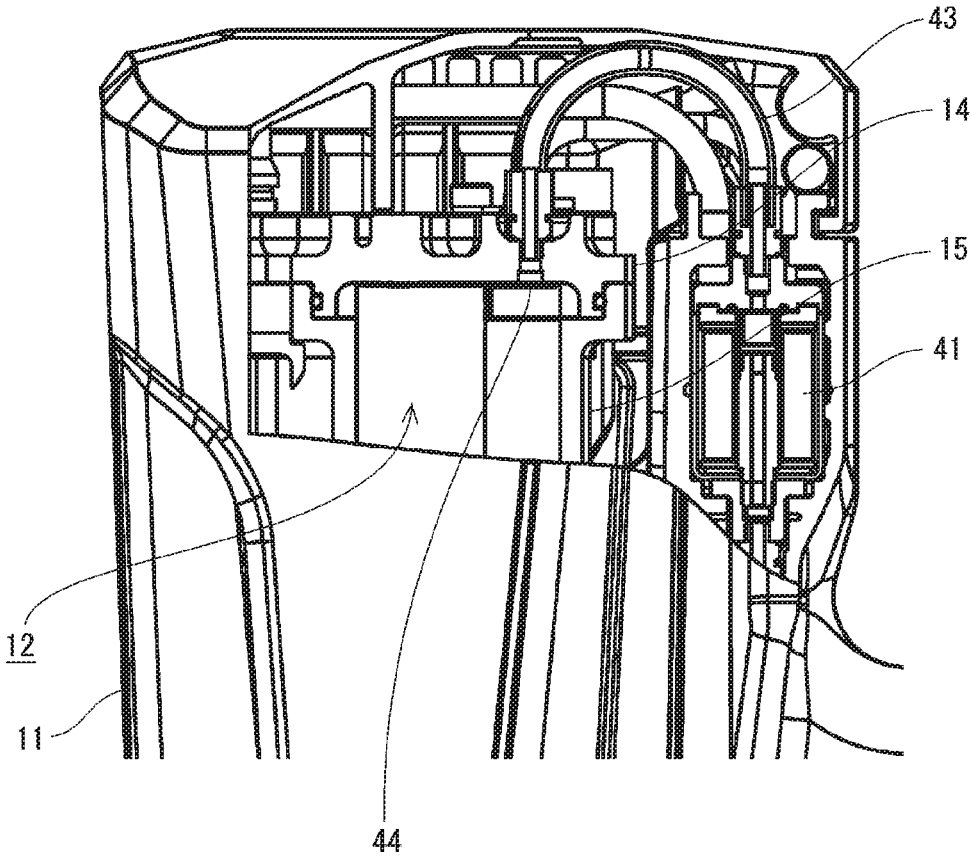
FIG. 7 is an enlarged side view (partial sectional view taken along the line B-B) of the gas combustion type driving tool.

The second air pipe 43 has an upstream end connected to the air ejection valve 41 and a downstream end connected to the combustion chamber 12. The second air pipe 43 is used for introducing the compressed air ejected by the air ejection valve 41 into the combustion chamber 12. As illustrated in FIGS. 6 and 8, the second air pipe 43 is disposed to wrap the cylinder head 14 from rear. As illustrated in FIGS. 5 and 7, the cylinder head 14 is provided with an air ejection unit 44 for connecting the second air pipe 43, so that the compressed air passing through the second air pipe 43 flows into the combustion chamber 12 through the air ejection unit 44.

The second air pipe 43 according to the present embodiment is formed of an elastically bendable tube. Accordingly, the second air pipe 43 is less likely to break or come off even when vibration and shocks occur during the driving operation.

As described above, combustible gas in the fuel container is introduced through the connection portion 37*b* of the fuel container storage unit 37. The gas combustion type driving tool 10 according to the present embodiment includes a pipe for connecting the connection portion 37*b* and the combustion chamber 12. Specifically, the gas combustion type driving tool 10 includes a first gas pipe 46 constituting an introduction path from the connection portion 37*b* to a gas ejection valve 45 (described below), and a second gas pipe 47 constituting an introduction path from the gas ejection valve 45 to the combustion chamber 12.

The first gas pipe 46 has an upstream end connected to the connection portion 37*b*, and a downstream end connected to the gas ejection valve 45. As illustrated in FIG. 3, the first gas pipe 46 is disposed along the output unit 11.

The gas ejection valve 45 is an electromagnetic valve that controls an amount of combustible gas supplied to the combustion chamber 12. The gas ejection valve 45 measures the combustible gas supplied through the first gas pipe 46, and ejects a certain amount of the combustible gas into the combustion chamber 12. As illustrated in FIG. 4, the gas ejection valve 45 according to the present embodiment is adjacent to the combustion chamber 12. Therefore, a distance of the second gas pipe 47 to be described below can be short, making it possible to improve a response of the tool. The first gas pipe 46 according to the present embodiment is longer than the second gas pipe 47. In this way, the response of the tool is improved by lengthening the first gas pipe 46 and shortening the second gas pipe 47. In the present embodiment, the second gas pipe 47 has the same length with the second air pipe 43.

The second gas pipe 47 has an upstream end connected to the gas ejection valve 45, and a downstream end connected to the combustion chamber 12. The second gas pipe 47 is used for introducing the combustible gas ejected by the gas ejection valve 45 into the combustion chamber 12. As illustrated in FIGS. 4 and 8, the second gas pipe 47 is disposed to wrap the cylinder head 14 from rear. As illustrated in FIG. 5, the cylinder head 14 is provided with a gas ejection unit 48 for connecting the second gas pipe 47, so that the combustible gas passing through the second gas pipe 47 flows into the combustion chamber 12 through the gas ejection unit 48. The second gas pipe 47 according to the present embodiment is formed of an elastically bendable tube. Accordingly, the second gas pipe 47 is less likely to break or come off even when vibration and shocks occur during the driving operation.

Next, a driving operation of the gas combustion type driving tool 10 according to the present embodiment is described with reference to FIG. 9.

Figure 9:
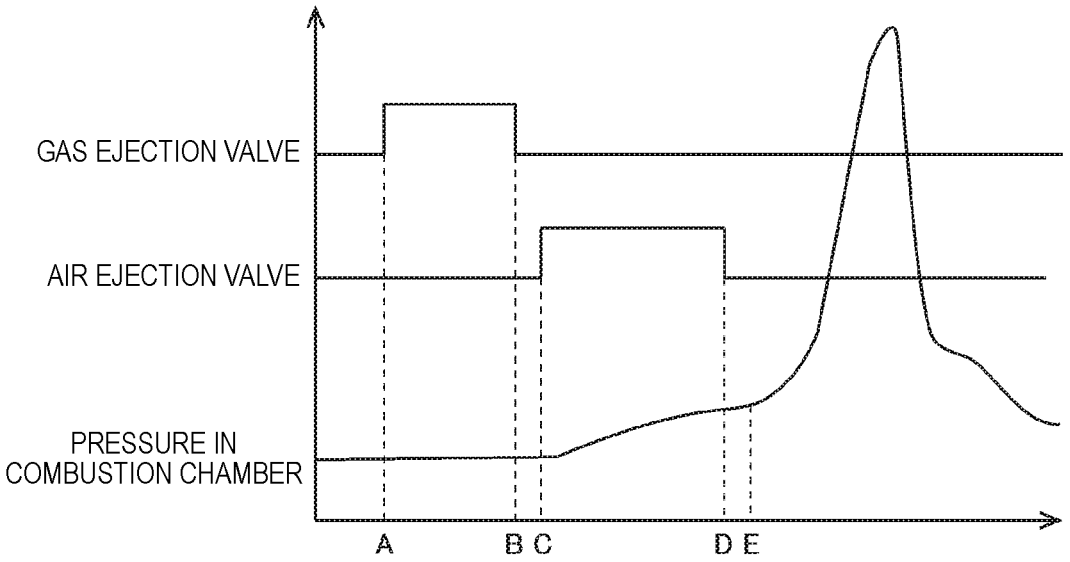
FIG. 9 is a timing chart showing operation of the gas combustion type driving tool.

When the trigger operating unit 31 is operated to start the driving operation, the control device 33 first opens the gas ejection valve 45 at a timing indicated by A in FIG. 9. The gas ejection valve 45 is opened for a predetermined time, and is closed at a timing indicated by B when the predetermined time elapses. Accordingly, a predetermined amount of combustible gas is supplied into the combustion chamber 12.

Next, the control device 33 opens the air ejection valve 41 at a timing indicated by C in FIG. 9. The air ejection valve 41 is opened for a predetermined time, and is closed at a timing indicated by D when the predetermined time elapses. Accordingly, a predetermined amount of compressed air is supplied into the combustion chamber 12.

When the combustible gas and the compressed air are introduced into the combustion chamber 12 to form mixed gas, the control device 33 operates the ignition device 13 at a timing indicated by E in FIG. 9 to ignite the mixed gas. Accordingly, pressure in the combustion chamber 12 is rapidly increased. When the pressure in the combustion chamber 12 is increased, the movable plug 21 is activated, so that the combustion gas flows into rear of the piston 16. Accordingly, the combustion pressure makes the piston 16 slide by operating on the piston 16, so that a fastener is driven out by the driver 17 that slides integrally with the piston 16.

As described above, according to the present embodiment, a fastener can be driven out by the combustion pressure when the mixed gas of the combustible gas supplied from the fuel container and the compressed air supplied from outside via the coupler 40 is ignited. Therefore, a large output can be obtained by energy of the compressed air and thermal energy of the combustion gas even if a volume of the combustion chamber 12 or an air chamber is not extremely large. Specifically, output comparable to a pyrotechnic type driving tool can be obtained with a tool size in a range that can be used as a hand-held tool. Further, unlike the pyrotechnic type driving tool, the tool can be used without a special license, and maintenance is also easy.

Since the coupler 40 and the combustion chamber 12 (the output unit 11) are connected via a pipe, it is not necessary to ensure pressure resistance of a main housing of the tool as a pneumatic tool in the related art. Therefore, for example, a housing constituting the grip 30 can be made of resin, so that a weight and costs of the tool can be reduced.

The coupler 40 is on the lower end side of the grip 30, and includes a pipe (first air pipe 42) for connecting the coupler 40 and the combustion chamber 12. Such a configuration makes it possible to freely arrange a position of the coupler 40. For example, it is possible to adopt a layout in which the battery pack 50 is mounted on a lower end portion of the grip 30 and the coupler 40 (inlet for compressed air) is disposed in proximity to the battery pack 50. According to such a layout, weight balance of the tool can be improved by allowing the battery pack 50 to be mounted on the lower end portion of the grip 30. Further, work can be easily done since work places such as attachment and detachment of the battery pack 50 and a hose are both on the lower end side of the grip 30. Since it is possible to dispose the coupler 40 at a position away from the output unit 11 so as not to receive shocks of the output unit 11, loosening of the coupler 40 due to shocks can be prevented.

In the embodiment described above, a pipe (first air pipe 42) for connecting the coupler 40 and the combustion chamber 12 is disposed outside the housing along the fuel container storage unit 37. However, the present invention is not limited thereto, and the pipe may be disposed at another location. For example, the pipe may be attached to outside of the housing along the magazine 38.

In the embodiment described above, the pipe (first air pipe 42) for connecting the coupler 40 and the combustion chamber 12 is partially exposed outside of the housing of the tool. However, the present invention is not limited thereto, and the pipe may be attached so as not to be exposed at all. Although the assembling properties are reduced when the pipe is not exposed, it is possible to obtain an effect that the pipe can be protected even when the tool is hit or the like. When the pipe is not exposed, the pipe may be integrally formed in the housing (the fuel container storage unit 37 or the like).

When the pipe is not exposed, not only a pipe holding unit may be formed on a housing surface, but also the pipe may pass through the grip 30 or through the fuel container storage unit 37.

What is claimed is:

1. A gas combustion type driving tool comprising:

an output unit that includes a combustion chamber;

a nose portion that is attached to an end of the output unit and is configured to guide a fastener toward a workpiece;

a grip that is connected to a surface of the output unit and is substantially orthogonal to a direction in which a fastener is driven out;

a fuel container storage unit to which a fuel container is detachably attached;

a battery mounting unit which is provided at an end portion of the grip and to which a battery pack is detachably attached; and a coupler that is configured to be coupled with a hose connected to an outside compressed air supply source and is configured to receive compressed air from the outside compressed air supply source, wherein the output unit is configured to drive out a fastener by a piston operated by combustion pressure generated in the combustion chamber when mixed gas of combustible gas supplied from the fuel container and compressed air supplied from outside via the coupler is ignited, wherein, with respect to a direction orthogonal to a direction in which the fastener is driven out, the gas combustion type driving tool includes a first end and a second end at an opposite end from the first end, the output unit is located closer to the first end than the grip, and the grip extends toward the second end, wherein the coupler is disposed at an end portion side of the grip such that the coupler is closer to the second end of the gas combustion type driving tool than a center of the grip, wherein the gas combustion type driving tool includes a pipe configured to connect the coupler and the combustion chamber, and wherein with respect to the direction orthogonal to the direction in which the fastener is driven out, the coupler is disposed closer to a side of the nose portion than the grip in the direction in which the fastener is driven out, the combustion chamber is disposed adjacent to the nose portion in the direction in which the fastener is driven out, and the grip is disposed between the coupler and the nose portion with respect to a direction extending from the first end to the second end.

2. The gas combustion type driving tool according to claim 1, wherein at least a part of the pipe is exposed outside of a housing of the tool.

3. The gas combustion type driving tool according to claim 1, wherein the pipe is formed of an elastically bendable tube.

4. The gas combustion type driving tool according to claim 1, further comprising:

an air ejection valve that is configured to eject compressed air into the combustion chamber, wherein a part of the pipe connects the coupler and the air ejection valve.

5. The gas combustion type driving tool according to claim 4, wherein the part of the pipe connecting the coupler and the air ejection valve is longer than another part of the pipe connecting the air ejection valve and the combustion chamber.

6. The gas combustion type driving tool according to claim 1, wherein the battery mounting unit is provided on an end surface of the grip, and wherein, with respect to a direction in which the grip extends, the coupler is located at a position shifted laterally from the battery mounting unit.

7. The gas combustion type driving tool according to claim 1, wherein the coupler does not protrude downward from the battery pack mounted on the battery mounting unit.

8. The gas combustion type driving tool according to claim 1, wherein the coupler is provided between the grip and the fuel container storage unit when viewed from a side of the gas combustion type driving tool and in the direction orthogonal to the direction in which the fastener is driven out.

9. The gas combustion type driving tool according to claim 1, wherein the coupler is provided between the grip and a magazine in which fasteners are loaded when viewed from a side of the gas combustion type driving tool.

10. The gas combustion type driving tool according to claim 1, wherein with respect to the direction orthogonal to the direction in which the fastener is driven out, the coupler is disposed closer to a side of the nose portion than the battery mounting unit in the direction in which the fastener is driven out.

11. The gas combustion type driving tool according to claim 10, wherein with respect to the direction orthogonal to the direction in which the fastener is driven out, the pipe extends from the coupler on a side of the nose portion than the battery mounting unit in the direction in which the fastener is driven out, and the pipe extends from the coupler toward the combustion chamber closer to a side of the nose portion than the grip in the direction in which the fastener is driven out.

12. The gas combustion type driving tool according to claim 10, wherein with respect to the direction orthogonal to the direction in which the fastener is driven out, the battery mounting unit is located at an end surface of the grip, and the coupler is proximate to the battery mounting unit and a location at which the battery pack is detachably attached to the battery mounting unit, such that the coupler provides an air inlet for the gas combustion type driving tool for coupling of the hose of the outside compressed air supply source at a location proximate to the location at which the battery pack is detachably attached.

13. A gas combustion type driving tool comprising:

an output unit that includes a combustion chamber;

a nose portion that is attached to an end of the output unit and is configured to guide a fastener toward a workpiece;

a grip that is connected to a surface of the output unit and is substantially orthogonal to a direction in which a fastener is driven out;

a fuel container storage unit to which a fuel container is detachably attached;

a battery mounting unit which is provided at an end portion of the grip and to which a battery pack is detachably attached; and a coupler that is configured to be coupled with a hose connected to an outside compressed air supply source and is configured to receive compressed air from the outside compressed air supply source, wherein the output unit is configured to drive out a fastener by a piston operated by combustion pressure generated in the combustion chamber when mixed gas of combustible gas supplied from the fuel container and compressed air supplied from outside via the coupler is ignited, wherein, with respect to a direction orthogonal to a direction in which the fastener is driven out, the gas combustion type driving tool includes a first end and a second end at an opposite end from the first end, the output unit is located closer to the first end than the grip, and the grip extends toward the second end, wherein the coupler is disposed at an end portion side of the grip such that the coupler is closer to the second end of the gas combustion type driving tool than a center of the grip, wherein the gas combustion type driving tool includes a pipe configured to connect the coupler and the combustion chamber, and wherein with respect to the direction orthogonal to the direction in which the fastener is driven out, the battery mounting unit is located at an end surface of the grip, and the coupler is proximate to the battery mounting unit and a location at which the battery pack is detachably attached to the battery mounting unit, such that the coupler provides an air inlet for the gas combustion type driving tool for coupling of the hose of the outside compressed air supply source at a location proximate to the location at which the battery pack is detachably attached.

14. The gas combustion type driving tool according to claim 13, wherein an opening of the coupler, which receives air from the outside compressed air supply source faces toward the second end of the gas combustion type driving tool.

15. The gas combustion type driving tool according to claim 14, wherein the coupler does not protrude beyond a side of the battery pack with respect to the direction orthogonal to the direction in which the fasten is driven out.

* * * * *